US007972164B2

(12) United States Patent
Bucher

(10) Patent No.: US 7,972,164 B2
(45) Date of Patent: Jul. 5, 2011

(54) CONNECTOR ASSEMBLY WITH A LATCH

(75) Inventor: Alan Bucher, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 283 days.

(21) Appl. No.: 12/410,412

(22) Filed: Mar. 24, 2009

(65) Prior Publication Data

US 2010/0248553 A1 Sep. 30, 2010

(51) Int. Cl.
*H01R 13/627* (2006.01)

(52) U.S. Cl. ..... 439/354

(58) Field of Classification Search ..... 439/352, 439/353, 354, 357

See application file for complete search history.

(56) References Cited

U.S. PATENT DOCUMENTS

| | | | | |
|---|---|---|---|---|
| 3,179,738 | A * | 4/1965 | De Lyon | 439/350 |
| 4,655,527 | A * | 4/1987 | Vandame | 439/350 |
| 4,713,021 | A | 12/1987 | Kobler | |
| 4,979,910 | A * | 12/1990 | Revil et al. | 439/357 |
| 5,190,467 | A * | 3/1993 | Ohta | 439/354 |
| 5,389,007 | A | 2/1995 | Reinelt | |
| 5,399,045 | A * | 3/1995 | Yoneda et al. | 403/321 |
| 5,538,437 | A | 7/1996 | Bates, III et al. | |
| 5,980,297 | A * | 11/1999 | Sugie | 439/354 |
| 6,089,898 | A | 7/2000 | Lincoln, III et al. | |
| 6,315,590 | B1 * | 11/2001 | Grois et al. | 439/248 |
| 6,332,800 | B2 * | 12/2001 | Kodama | 439/357 |
| 6,383,032 | B1 | 5/2002 | Gerberding | |
| 6,419,515 | B1 | 7/2002 | Okayasu | |
| 6,443,760 | B2 | 9/2002 | Hasegawa | |
| 6,450,830 | B1 | 9/2002 | Koseki | |
| 6,461,186 | B1 | 10/2002 | Endo | |
| 6,582,243 | B2 | 6/2003 | Endo et al. | |
| 6,592,404 | B2 * | 7/2003 | Endo | 439/595 |
| 6,666,727 | B2 * | 12/2003 | Konno et al. | 439/682 |
| 6,824,417 | B1 | 11/2004 | Nimura | |
| 6,918,783 | B2 | 7/2005 | Endo et al. | |
| 7,029,328 | B1 | 4/2006 | Mckenzie et al. | |
| 7,108,534 | B2 | 9/2006 | Fabian | |
| 7,114,983 | B2 | 10/2006 | Fukatsu et al. | |
| 7,223,114 | B2 * | 5/2007 | Tateishi et al. | 439/354 |
| 7,252,530 | B2 | 8/2007 | Shamoto | |
| 7,275,951 | B2 | 10/2007 | Shigeta et al. | |
| 7,297,019 | B2 | 11/2007 | Landis et al. | |
| 7,410,386 | B2 | 8/2008 | Fabian et al. | |
| 2005/0042911 | A1 | 2/2005 | Koenig | |
| 2007/0270017 | A1 * | 11/2007 | Hardacker et al. | 439/357 |
| 2010/0248553 | A1 * | 9/2010 | Bucher | 439/668 |

OTHER PUBLICATIONS

International Search Report, International Application No. PCT/US2010/000833, International Filing Date Mar. 24, 2009.

* cited by examiner

*Primary Examiner* — James Harvey

(57) ABSTRACT

A connector assembly includes a receptacle connector including a receptacle connector housing having an interior cavity. The receptacle connector includes a latch element extending within the interior cavity of the receptacle housing. The receptacle housing holds a receptacle connector contact. The connector assembly also includes a plug connector having a plug connector housing engaged with the receptacle connector housing. The plug connector housing holds a plug connector contact. The plug connector contact is engaged with the receptacle connector contact. The plug connector includes a latch arm extending outwardly from the plug connector housing. The latch arm includes a latch member received within the interior cavity of the receptacle connector housing. The latch member is engaged with the latch element of the receptacle connector entirely within the interior cavity of the receptacle connector housing.

16 Claims, 7 Drawing Sheets

CONNECTOR ASSEMBLY WITH A LATCH

BACKGROUND OF THE INVENTION

The subject matter described and/or illustrated herein generally relates to connector assemblies and, more particularly, to latches for holding mated connectors together.

Various types of connector assemblies include connectors that are mated together by loading one connector into the other. The mated connectors may be held together using a latch. Specifically, a latch element of one connector is engaged with a latch element of the other connector to hold the mated connectors together. The connectors are separated by disengaging the latch elements and pulling the connectors apart in an unloading direction that is opposite the loading direction. The latches of such connector assemblies often include a latch arm on one of the connectors that includes the corresponding latch element on an end thereof. The latch element on the end of the latch arm is often a hook, but may alternatively be an opening or depression. The latch arm is pivotable between a latched position and an unlatched position. In the latched position, the latch element on the end of the latch arm is engaged with the latch element of the other connector. In the unlatched position, the latch element on the end of the latch arm is disengaged with the latch element of the other connector. The latches of at least some known connector assemblies are exposed on an exterior surface of the connectors. For example, the latch arm and/or the latch elements are often exposed on an exterior surface of the connector housings when the connectors are mated together.

Connector assemblies that terminate wires are often pulled through passages and/or holes within structures such as bulkheads, panels, walls, enclosures, containers, and/or the like. When pulled through a structure, latches that are exposed on an exterior surface of the connector assembly may catch or snag on obstructions such as cables, wires, portions of the structure or adjacent structures, and/or the like. For example, exposed latch arms and/or latch elements of the latch may catch or snag on obstructions. Catching or snagging of the latch on obstructions may damage the latch, the connectors, the obstructions, and/or the structures. Catching or snagging of the latch on obstructions may increase the difficulty of installing the connector assembly. Moreover, catching or snagging of a latch arm that is exposed on the exterior surface of the connector assembly may pry the latch arm from the latched position to the unlatched position. Prying the latch arm from the latched position to the unlatched position may damage the latch and/or inadvertently unlatch the connectors.

BRIEF DESCRIPTION OF THE INVENTION

In one embodiment, a connector assembly includes a receptacle connector including a receptacle connector housing having an interior cavity. The receptacle connector includes a latch element extending within the interior cavity of the receptacle housing. The receptacle housing holds a receptacle connector contact. The connector assembly also includes a plug connector having a plug connector housing engaged with the receptacle connector housing. The plug connector housing holds a plug connector contact. The plug connector contact is engaged with the receptacle connector contact. The plug connector includes a latch arm extending outwardly from the plug connector housing. The latch arm includes a latch member received within the interior cavity of the receptacle connector housing. The latch member is engaged with the latch element of the receptacle connector entirely within the interior cavity of the receptacle connector housing.

In another embodiment, a connector is configured to latch and unlatch with a mating connector having a latch arm. The connector includes a housing having a mating end configured to engage the mating connector. A contact is held by the housing. A latch receptacle extends into the mating end of the housing. The latch receptacle is configured to receive the latch arm of the mating connector therein. A latch element extends entirely within the latch receptacle. The latch element includes a latching surface configured to engage the latch arm of the mating connector.

In another embodiment, a connector is configured to latch and unlatch with a mating connector having a latch receptacle and a latch element extending within the latch receptacle. The connector includes a housing having a base and a plurality of extensions extending outwardly from the base within a plane. The extensions are configured to engage the mating connector. The connector also includes a plurality of contacts. Each of the plurality of contacts is held by a corresponding one of the extensions. A latch arm extends outwardly from the base of the housing. The latch arm extends within the plane between two adjacent extensions of the plurality of extensions. The latch arm is configured to be received within the latch receptacle of the mating connector. The latch arm includes a latch member configured to engage the latch element of the mating connector.

DETAILED DESCRIPTION OF THE INVENTION

Figure 1:
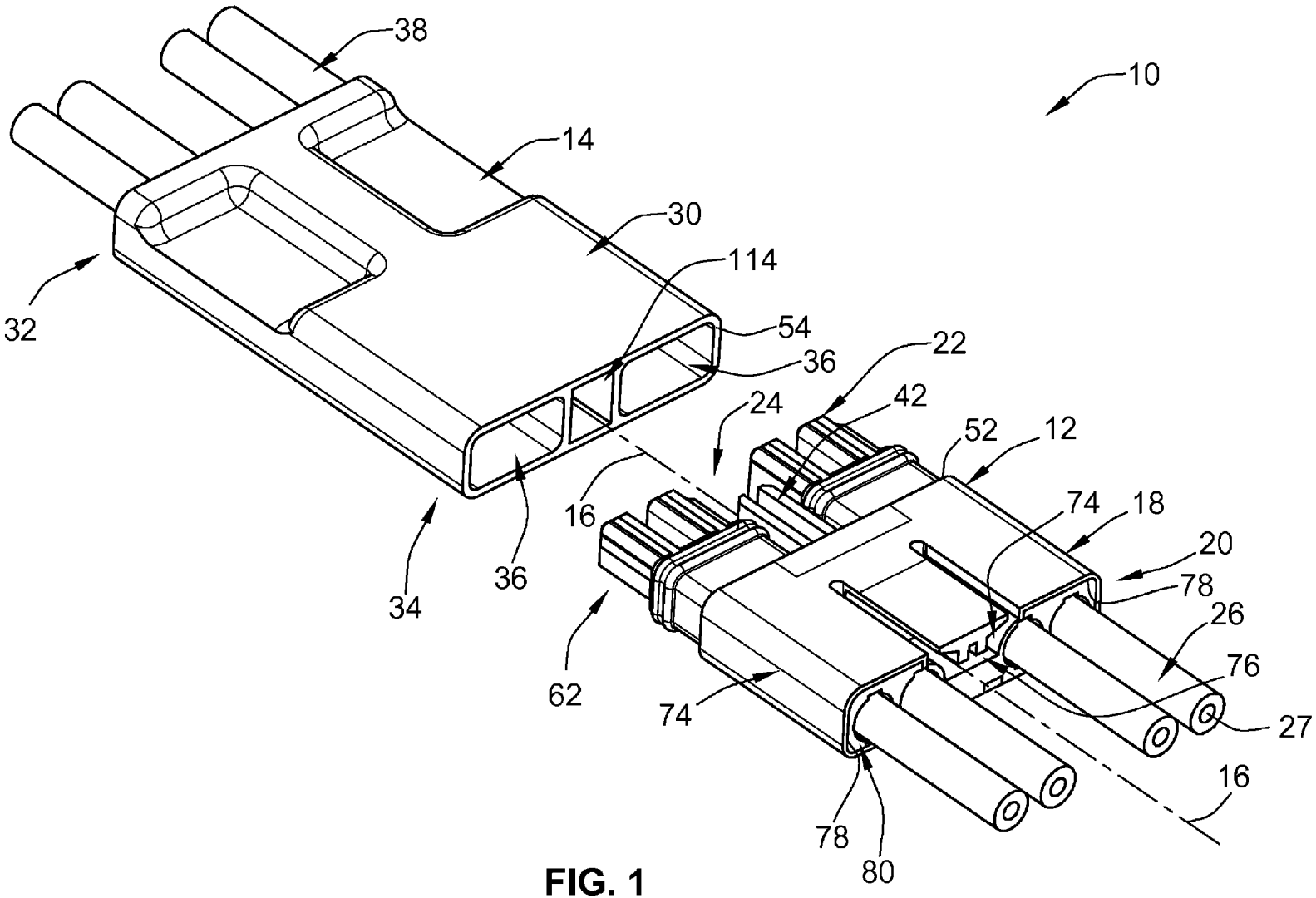
FIG. 1 is a perspective view of an exemplary embodiment of a connector assembly illustrating the connector assembly in an un-mated condition.

FIG. 1 is a perspective view of an exemplary embodiment of a connector assembly 10 illustrating the connector assembly 10 in an un-mated condition. The connector assembly 10 includes a plug connector 12 and a receptacle connector 14, which mate together along a connection axis 16. The plug connector 12 includes a housing 18 extending a length from a wire entry end 20 to a mating end 22. The mating end 22 includes a mating interface 24. The wire entry end 20 receives one or more electrical wires 26. In the exemplary embodiment, each electrical wire 26 includes an electrical conductor 27 that extends into the housing 18 and is electrically connected to a corresponding electrical contact 28 (FIG. 3) held by the housing 18 along the mating interface 24. The electrical wires 26 may be individually routed wires or wires grouped in a cable. The plug connector 12 may be referred to herein as a "mating connector" and/or as a "connector".

The receptacle connector 14 includes a housing 30 extending a length from a wire entry end 32 to a mating end 34. The mating end 34 includes a mating interface 36. The wire entry end 32 receives one or more electrical wires 38. In the exemplary embodiment, each electrical wire 38 includes an electrical conductor (not shown) that extends into the housing 30 and is electrically connected to a corresponding electrical contact 40 (FIG. 6) held by the housing 30 along the mating interface 36. The electrical wires 38 may be individually routed wires or wires grouped in a cable. The receptacle connector 14 may be referred to herein as a "mating connector" and/or as a "connector".

An alternative embodiment of a receptacle connector (not shown) is electrically connected to a circuit board (not shown). For example, an alternative embodiment of a receptacle connector is electrically connected to electrically conductive posts (not shown) that are mounted on or through a circuit board. In such an alternative embodiment, the posts take the place of the electrical contacts 40 in the receptacle connector 14, and electrically conductive traces of the circuit board take the place of the electrical wires 38. The posts are electrically connected to the electrically conductive traces. In such an alternative embodiment, the receptacle connector is commonly referred to as a "header".

When the connectors 12 and 14 are mated together at the mating interfaces 24 and 36, each electrical contact 28 of the plug connector 12 engages a corresponding one of the electrical contacts 40 of the receptacle connector 14 to establish a separable electrical connection between the electrical conductors of corresponding electrical wires 26 and 38. As will be described below, the plug connector 12 includes a pluggable latch arm 42 that engages a latch element 44 (FIGS. 4 and 7) of the receptacle connector 14 to latch the connectors 12 and 14 together.

Figure 2:
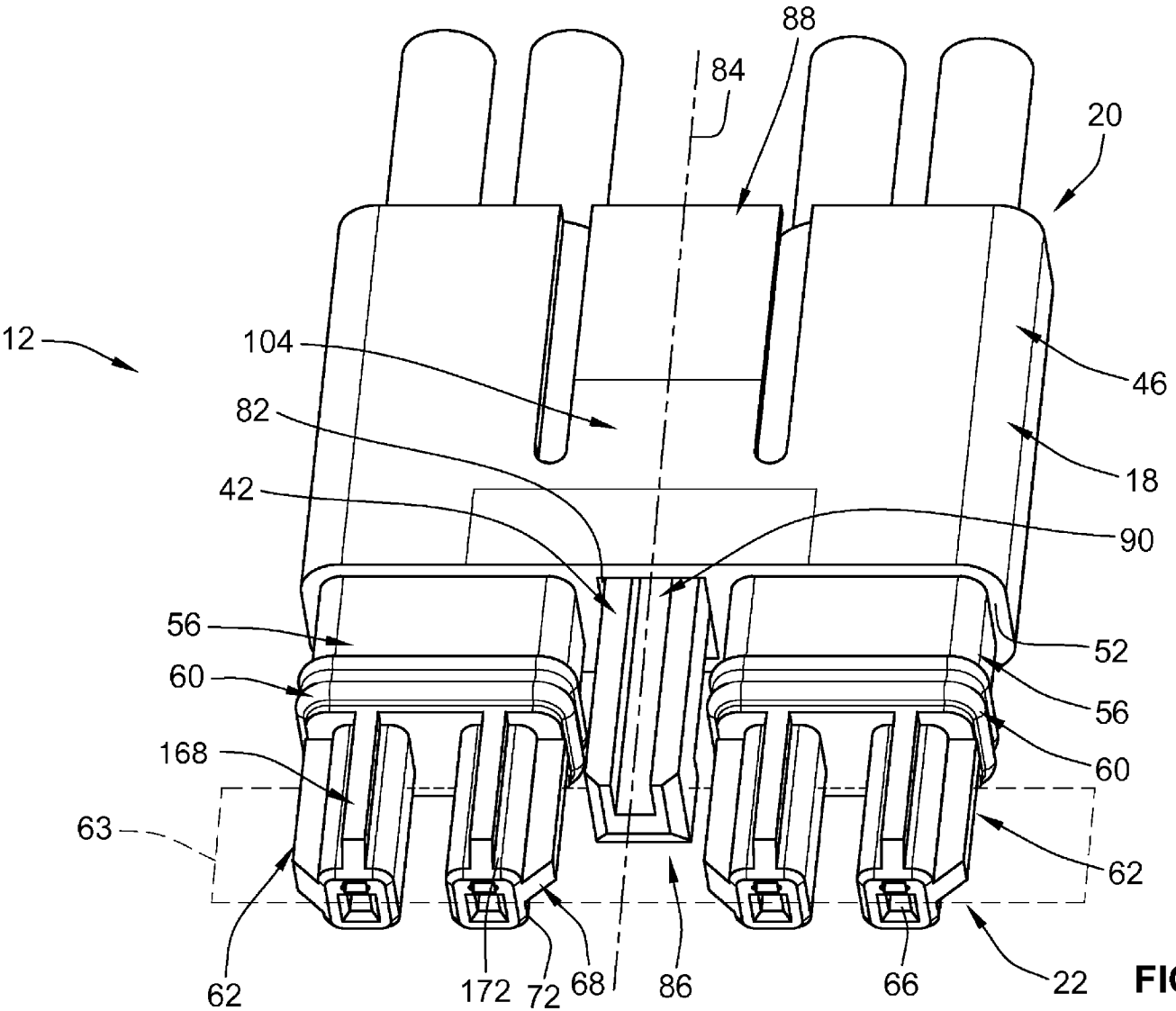
FIG. 2 is a perspective view of an exemplary embodiment of a plug connector of the connector assembly shown in FIG. 1.
Figure 3:
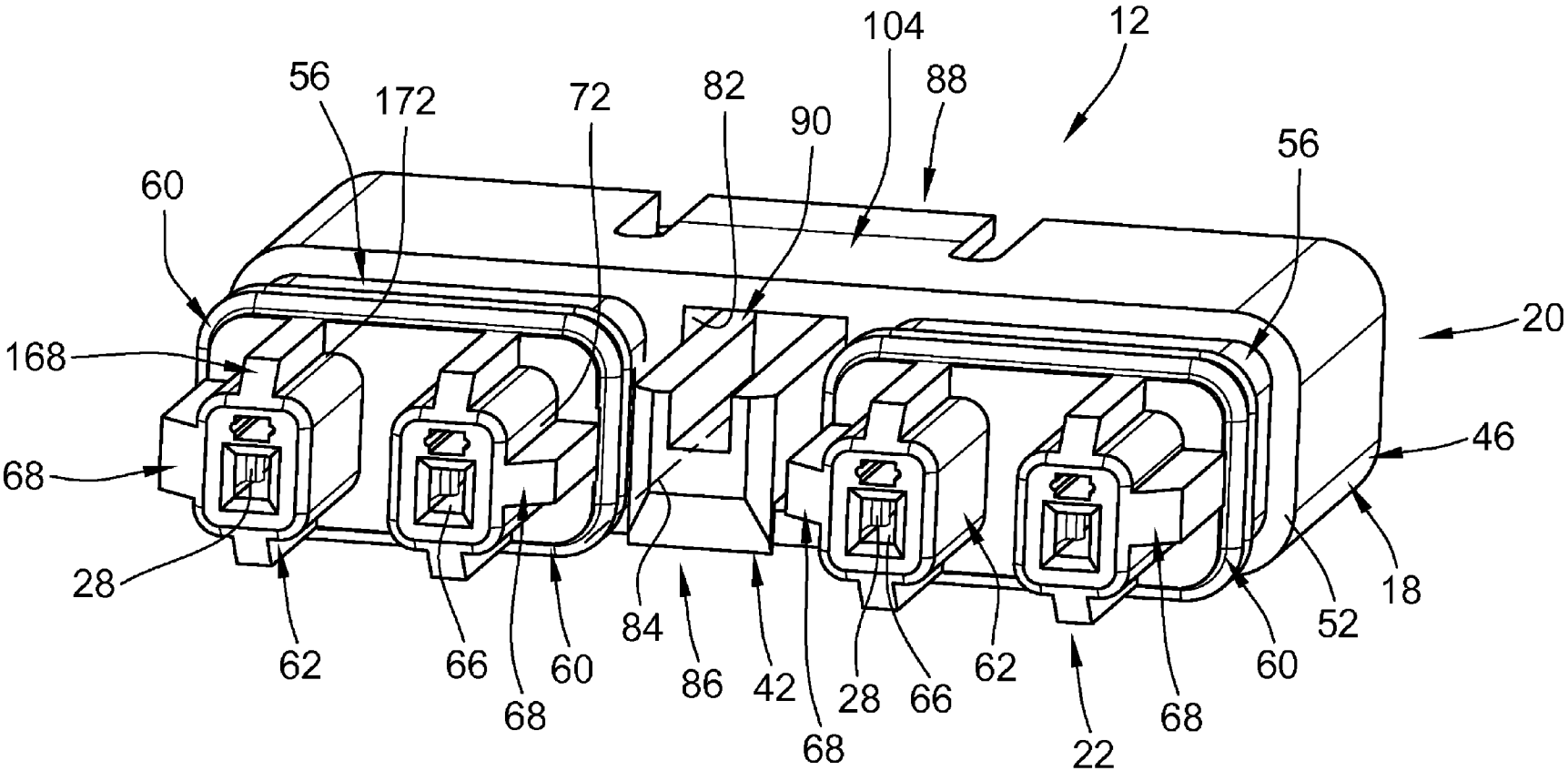
FIG. 3 is a perspective view of the plug connector shown in FIG. 2 viewed from a different angle than FIG. 2.

FIG. 2 is a perspective view of an exemplary embodiment of the plug connector 12. FIG. 3 is a perspective view of the plug connector 12 viewed from a different angle than FIG. 2. The plug connector 12 includes the housing 18 extending a length from the wire entry end 20 to the mating end 22. The housing 18 includes a base 46 extending from an engagement surface 52 to the wire entry end 20 of the housing 18. The engagement surface 52 abuts an end surface 54 (FIGS. 5 and 6) of the receptacle connector 14 (FIGS. 1 and 4-7) when the connectors 12 and 14 are fully mated together. In the exemplary embodiment, the housing 18 includes one or more extensions 56 that extend outwardly from the base 46 toward the mating end 22 of the housing 18. Each extension 56 is received within a corresponding opening 58 (FIGS. 5 and 6) of the receptacle connector 14 when the connectors 12 and 14 are mated together. Each extension 56 optionally includes a seal 60 surrounding the extension 56 for sealing the extension 56 with the housing 30 (FIGS. 1, 5, and 6) of the receptacle connector 14 at the corresponding opening 58. Although two extensions 56 are shown, the housing 18 may include any number of the extensions 56. The housing 18 may be referred to herein as a "plug connector housing" and/or as a "housing".

Each extension 56 includes one or more plugs 62 that extend outwardly from the extension 56 to the mating end 22 of the housing 18. The plugs 62 extend outward from the extensions 56 within a common plane 63 (not shown in FIG. 3). Each plug 62 is received within a corresponding socket 64 (FIG. 6) of the receptacle connector 14 when the connectors 12 and 14 are mated together. Each plug 62 includes a contact channel 66 that holds one of the electrical contacts 28 (not visible in FIG. 2) of the plug connector 12. When each plug 62 is received within the corresponding socket 64 of the receptacle connector 14, the electrical contact 28 of the plug 62 is engaged with and electrically connected to the electrical contact 40 (FIG. 6) held within the corresponding socket 64 of the receptacle connector 14. Each plug 62 optionally includes one or more keying elements 68 that cooperate with corresponding keying elements 70 (FIG. 6) of the receptacle connector 14. In the exemplary embodiment, the keying elements 68 are extensions that extend outwardly from one or more sidewalls 72 of the plugs 62. Optionally, extensions 168 extend from side walls 172 of the plugs 62 to limit pitching of the plug 62 as the extensions 168 encounter corresponding interior surfaces of the openings 58 of the sockets 64 during mating. Although four plugs 62 are shown, the housing 18 may include any number of the plugs 62. The electrical contact 28 may be referred to herein as a "plug connector contact" and/or as a "contact". The plug 62 may be referred to herein as an "extension".

Referring again to FIG. 1, the housing 18 includes one or more wire barrels 74 extending along the base 46 from the wire entry end 20 toward the mating end 22 of the housing 18. In the exemplary embodiment, the housing 18 includes two wire barrels 74. A recess 76 is defined between the wire barrels 74. Each wire barrel 74 includes one or more openings 78 extending into the wire entry end 20 of the housing 18 for receiving one or more of the electrical wires 26 into the housing 18. In the exemplary embodiment, each wire barrel 74 receives two of the electrical wires 26. Each opening 78 communicates with one or more corresponding contact channels 66 (FIGS. 2 and 3) of the plugs 62, for example via one or more passageways (not shown) within the base 46. The electrical conductors 27 of the electrical wires 26 are each engaged with and electrically connected to the electrical contact 28 held within the contact channel 66 of a corresponding one of the plugs 62. Optional wire seals (not shown) are received within and seal against the passageways. The wire seals include openings (not shown) for receiving and sealing around each electrical wire 26. An optional wire guide 80 is received within the openings 78 for retaining the wire seals, guiding the electrical wires 26 into the wire entry end 20 of the housing 18, and/or limiting lateral movement of the electrical wires 26.

Referring again to FIGS. 2 and 3, the plug connector 12 includes the latch arm 42. Specifically, the latch arm 42 extends through an opening 82 within the base 46. The latch arm 42 extends outwardly from the base 46 within the plane 63 (not shown in FIG. 3) of the plugs 62 and between the extensions 56 and two adjacent plugs 62. The latch arm 42 extends a length along a central longitudinal axis 84 from an engagement end 86 to an actuation end 88. An intermediate link 90 extends between the engagement end 86 and the actuation end 88. The intermediate link 90 extends within the base opening 82. The engagement end 86 of the latch arm 42 extends outwardly from the intermediate link 90, within the plane 63, toward the mating end 22 and between the extensions 56 and two adjacent plugs 62. The actuation end 88 of the latch arm 42 extends outwardly from the intermediate link 90 toward the wire entry end 20 and within the recess 76 between the wire barrels 74 of the housing 18. As will be described in more detail below, the latch arm 42 is connected to the housing base 46 at a flexing extension 104 that extends outwardly from the actuation end 88 of the latch arm 42 toward the mating end 22 of the housing 18.

In the exemplary embodiment, the plug connector 12 includes four plugs 62 that are arranged in a single row. Alternatively, the plug connector 12 includes plugs 62 that are arranged in more than one row such that the plugs 62 are arranged in a plurality of columns and rows. In such an embodiment where the plugs 62 are arranged in a plurality of columns and rows, the latch arm 42 may or may not extend within a plane of any of the rows of plugs 62, but will extend between two adjacent columns of the plugs 62 and/or between two adjacent rows of the plugs 62.

Figure 4:
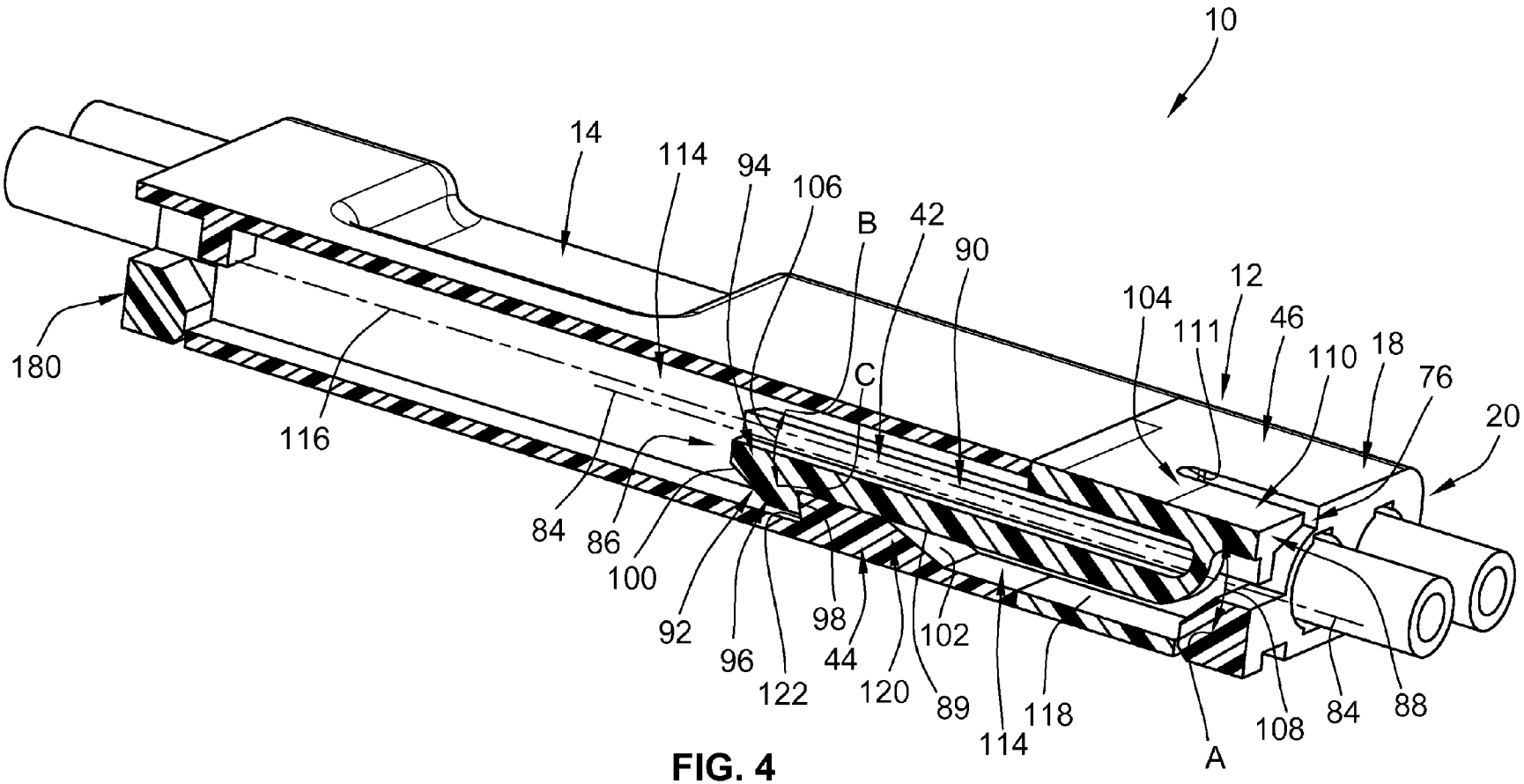
FIG. 4 is a perspective view of a cross section of the connector assembly shown in FIG. 1 illustrating the connector assembly latched in a mated condition.

FIG. 4 is a perspective view of a cross section of the connector assembly 10 illustrating the connector assembly 10 latched in a mated condition. The engagement end 86 of the latch arm 42 includes a latch member 92 that cooperates with the latch element 44 of the receptacle connector 14. In the exemplary embodiment, the latch member 92 includes a hook 94. Specifically, the hook 94 is defined by an extension 96 having a latching surface 98 that engages the latch element 44 of the receptacle connector 14. The extension 96 includes a ramp surface 100 that cooperates with a ramp surface 102 of the latch element 44 of the receptacle connector 14. In the exemplary embodiment, the latching surface 98 extends at an acute angle relative to an adjacent surface 89 of the intermediate link 90 of the latch arm 42. Alternatively, the latching surface 98 extends approximately perpendicular or at an obtuse angle relative to the surface 89 of the latch arm 42.

The actuation end 88 of the latch arm 42 extends outwardly from the intermediate link 90 toward the wire entry end 20 and within the recess 76 of the housing 18. The actuation end 88 of the latch arm 42 includes a release tab 110. As described above, the flexing extension 104 of the latch arm 42 connects the actuation end 88 of the latch arm 42 to the base 46. Specifically, the flexing extension 104 extends between, and interconnects, the release tab 110 and a wall 111 of the base 46. The flexing extension 104 is configured to deform, or bend, to enable the latch arm 42 to pivot about the flexing extension 104. Pivoting of the latch arm 42 about the flexing extension 104 causes the engagement end 86, and thus the latch member 92, to move along an arc 106 while the actuation end 88 of the latch arm 42 moves along an arc 108 within the recess 76. The latch member 92 can be moved along the arc 106 between a latched position, shown in FIG. 4, and an unlatched position, shown in FIG. 7. In the latched position, the latching surface 98 of the latch arm 42 is engaged with the latch element 44 of the receptacle connector 14 when the connectors 12 and 14 are mated together.

When the flexing extension 104 is not deformed, the latch member 92 is held in the latched position via a natural bias of the flexing extension 104. The release tab 110 can be pressed, for example using a person's finger (not shown) and/or a person's thumb (not shown) to move the actuation end 88 along the arc 108 in the direction of the arrow A. Movement of the actuation end 88 along the arc 108 in the direction of the arrow A causes the latch arm 42 to pivot about the flexing extension 104, against the bias of the flexing extension 104, such that the latch member 92 moves along the arc 106 in the direction of the arrow B from the latched position to the unlatched position.

Figure 5:
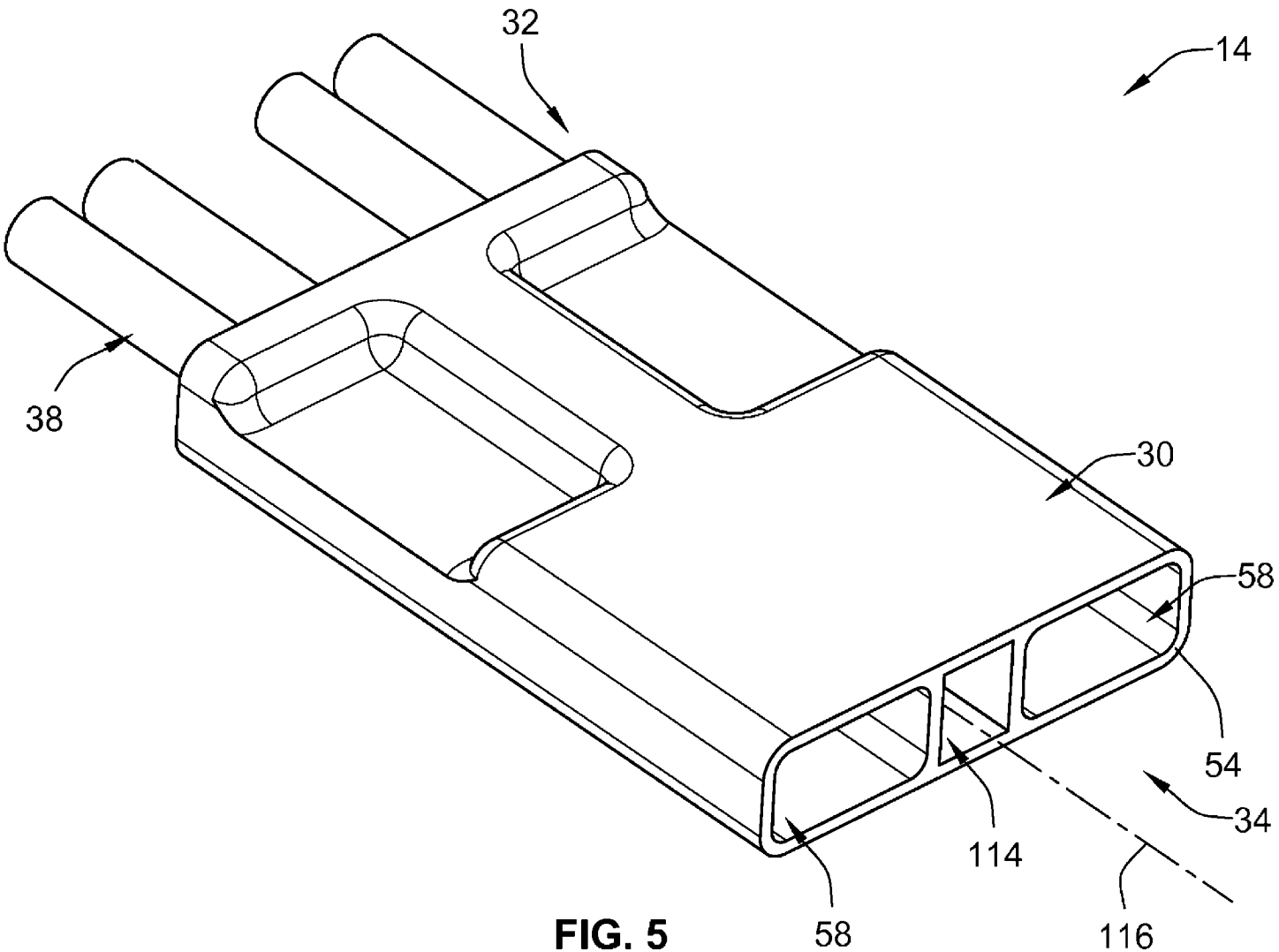
FIG. 5 is a perspective view of an exemplary embodiment of a receptacle connector of the connector assembly shown in FIG. 1.
Figure 6:
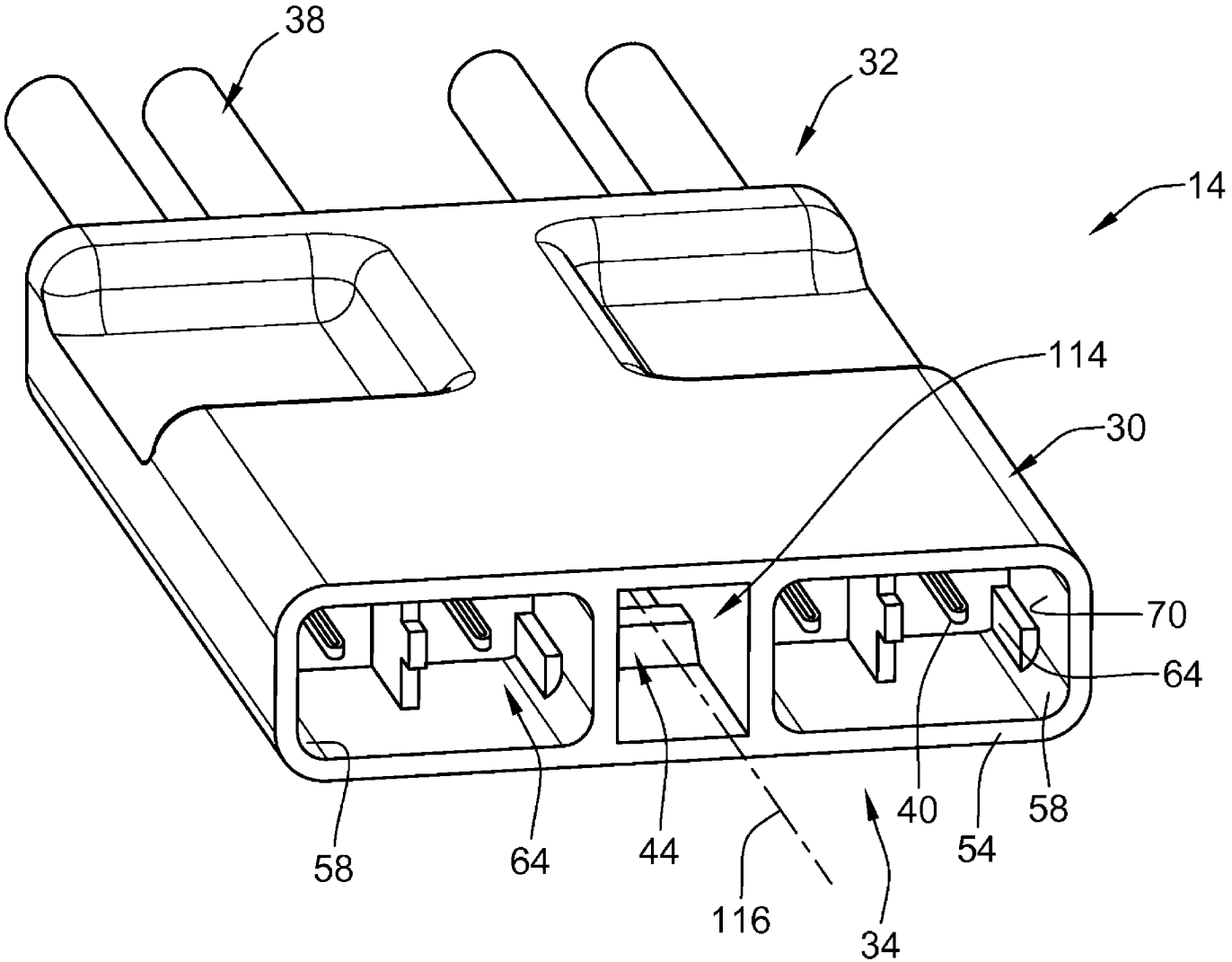
FIG. 6 is a perspective view of the receptacle connector shown in FIG. 5 viewed from a different angle than FIG. 5.

FIG. 5 is a perspective view of an exemplary embodiment of the receptacle connector 14. FIG. 6 is a perspective view of the receptacle connector 14 viewed from a different angle than FIG. 5. The receptacle connector 14 includes the housing 30 extending the length from the wire entry end 32 to the mating end 34. The mating end 34 of the housing 30 includes the end surface 54 that abuts the engagement surface 52 (FIGS. 1-3) of the plug connector 12 (FIGS. 1-4 and 7) when the connectors 12 and 14 are fully mated together. In the exemplary embodiment, the housing 30 includes one or more of the openings 58 that receive the corresponding extensions 56 (FIGS. 2 and 3) of the plug connector 12 when the connectors 12 and 14 are mated together. The mating end 34 of the housing 30 also includes one or more of the sockets 64 (not visible in FIG. 5) that receive the corresponding plugs 62 (FIGS. 1, 2, and 3) of the plug connector 12 when the connectors 12 and 14 are mated together. Although two openings 58 are shown, the housing 30 may include any number of the openings 58. The housing 30 may be referred to herein as a "receptacle connector housing".

Each socket 64 holds one of the electrical contacts 40 (not visible in FIG. 5) of the receptacle connector 14. When each plug 62 is received within the corresponding socket 64 of the receptacle connector 14, the electrical contact 28 (FIG. 3) of the plug 62 is engaged with and electrically connected to the electrical contact 40 held within the corresponding socket 64. Each socket 64 optionally includes one or more of the keying elements 70 (not visible in FIG. 5) that cooperate with the corresponding keying elements 68 (FIGS. 2 and 3) of the plug connector 12. In the exemplary embodiment, the keying elements 70 are slots that receive the keying elements 68 therein. Although four sockets 64 are shown, the housing 30 may include any number of the sockets 64. The electrical contact 40 may be referred to herein as a "receptacle connector contact".

The housing 30 includes one or more openings (not shown) extending into the wire entry end 32 for receiving the electrical wires 38 into the housing 18. In the exemplary embodiment, the housing 18 includes two openings and each opening receives two of the electrical wires 38. Each opening that extends into the wire entry end 32 communicates with one or more contact channels (not shown), for example via one or more passageways (not shown) within the housing 30. The electrical conductors (not shown) of the electrical wires 38 are each engaged with and electrically connected to corresponding ones of the electrical contacts 40 held within the sockets 64. Optional wire seals (not shown) are received within and seal against each of the passageways. The wire seals include openings (not shown) for receiving and sealing around each electrical wire 38. An optional wire guide 180 (FIGS. 4 and 7) is received within the openings of the housing 30 for retaining the wire seals, guiding the electrical wires 38 into the wire entry end 32 of the housing 30, and/or limiting lateral movement of the electrical wires 38.

The receptacle connector 14 includes a latch receptacle 114 that receives the pluggable latch arm 42 (FIGS. 2-4 and 7) of the plug connector 12 therein. Specifically, in the exemplary embodiment, the latch receptacle 114 extends between the openings 58 of the housing. The latch receptacle 114 extends a length into the mating end 34 of the housing 30 along a central longitudinal axis 116. As best seen in FIG. 6, in the exemplary embodiment, the openings 58 and the sockets 64 are each discrete and isolated from the latch receptacle 114. Alternatively, the housing 30 may include one or more openings (not shown) that interconnect the latch receptacle 114 to one or more of the sockets 64 and/or the openings 58 such that the latch receptacle 114 is not isolated (but is still discrete) from the socket(s) 64 and/or opening(s) 58.

In the exemplary embodiment, the receptacle connector 14 includes two openings 58 that are arranged in a single row. Alternatively, the receptacle connector 14 includes openings 58 that are arranged in more than one row such that the openings 58 are arranged in a plurality of columns and rows. In such an embodiment where the openings 58 are arranged in a plurality of columns and rows, the latch receptacle 114 may extend between two adjacent columns of the openings 58 and/or between two adjacent rows of the openings 58.

Referring now to FIG. 4, the latch receptacle 114 includes the latch element 44 that cooperates with the latch arm 42 of the plug connector 12. Specifically, the latch receptacle 114 includes an interior surface 118 that extends along the length of the latch receptacle 114 and defines a boundary of the latch receptacle 114. The latch element 44 extends outwardly from the interior surface 118 toward the central longitudinal axis 116. Accordingly, the latch element 44 extends entirely within the latch receptacle 114 of the housing 30. In the exemplary embodiment, the latch element 44 includes a shoulder 120. The shoulder 120 includes a latching surface 122 that engages the latching surface 98 of the latch arm 42 of the plug connector 12. The shoulder 120 optionally includes the ramp surface 102 that cooperates with the ramp surface 100 of the latch arm 42. In the exemplary embodiment, the latching surface 122 extends at an acute angle relative to an adjacent portion of the interior surface 118 of the latch receptacle 114. Alternatively, the latching surface 122 extends approximately perpendicular or at an obtuse angle relative to the adjacent portion of the interior surface 118 of the latch receptacle 114.

Referring again to FIG. 1, to mate the connectors 12 and 14 together, the housings 18 and 30 are moved toward each other along the connection axis 16 until the end surface 54 of the housing 30 abuts the engagement surface 52 of the housing base 46. Each plug 62 of the plug connector 12 is received within the corresponding socket 64 (FIG. 6) of the receptacle connector 14 such that the corresponding electrical contacts 28 and 40 (FIGS. 3 and 6, respectively) are engaged and electrically connected. Likewise, each extension 56 of the plug connector 12 is received within the corresponding opening 58 of the receptacle connector 14. The seal 60 of each extension 56 is engaged with the receptacle connector housing 30 within the corresponding opening 58 to seal the extensions 56 with the housing 30.

As the connectors 12 and 14 are moved toward each other along the connection axis 16, the pluggable latch arm 42 of the plug connector 12 is received within the latch receptacle 114 of the receptacle connector 14. Specifically, and referring now to FIG. 4, the engagement end 86 of the latch arm 42 is received into the latch receptacle 114. Before the latch member 94 of the latch arm 42 engages the latch element 44 of the latch receptacle 114, the latch arm 42 is in the latched position wherein the flexing block 104 is undeformed. As the engagement end 86 of the latch arm 42 is received into the latch receptacle 114, the latch member 94 of the latch arm 42 engages the latch element 44 of the latch receptacle 114 to move the latch arm 42 to the unlatched position. Specifically, the ramp surface 100 of the latch arm 42 engages the ramp surface 102 of the latch element 44. The ramp surface 100 rides along the ramp surface 102 such that the engagement end 86 of the latch arm 42 is moved, against the bias of the flexing block 104, along the arc 106 in the direction of the arrow B. In other words, the latch arm 42 is moved to the unlatched position. Once the latching surface 98 of the latch arm 42 has been received far enough into the latch receptacle 114 such that the latching surface 98 clears the latching surface 122 of the latch element 44, the natural bias of the flexing block causes the engagement end 86 of the latch arm 42 to move along the arc 106 in the direction of the arrow C. In other words, the latch arm 42 moves to the latched position. In the latched position, the latching surfaces 98 and 122 are engaged to latch the connectors 12 and 14 together.

As can be seen in FIG. 4, the latch element 44 of the receptacle connector 14 is engaged with the latch member 94 of the latch arm 42 of the plug connector 12 entirely within the latch receptacle 114. Accordingly, the latch element 44 and the latch member 94 are engaged with each other entirely within an interior cavity of the receptacle connector housing 30. The latch receptacle 114 may be referred to herein as an "interior cavity". In the exemplary embodiment, the latch arm 42 therefore cannot be unlatched by prying on the intermediate link 90 and/or the engagement end 86 of the latch arm 42. In some alternative embodiments, an opening (not shown) is provided within the housing 30 that enables access to the latch receptacle 114 such that the latch arm 42 can be unlatched by prying on the intermediate link 90 and/or the engagement end 86 of the latch arm 42 through the opening. Such openings may enable molding of the latch element 44 and/or other components, structure, and/or the like of the assembly 10.

Figure 7:
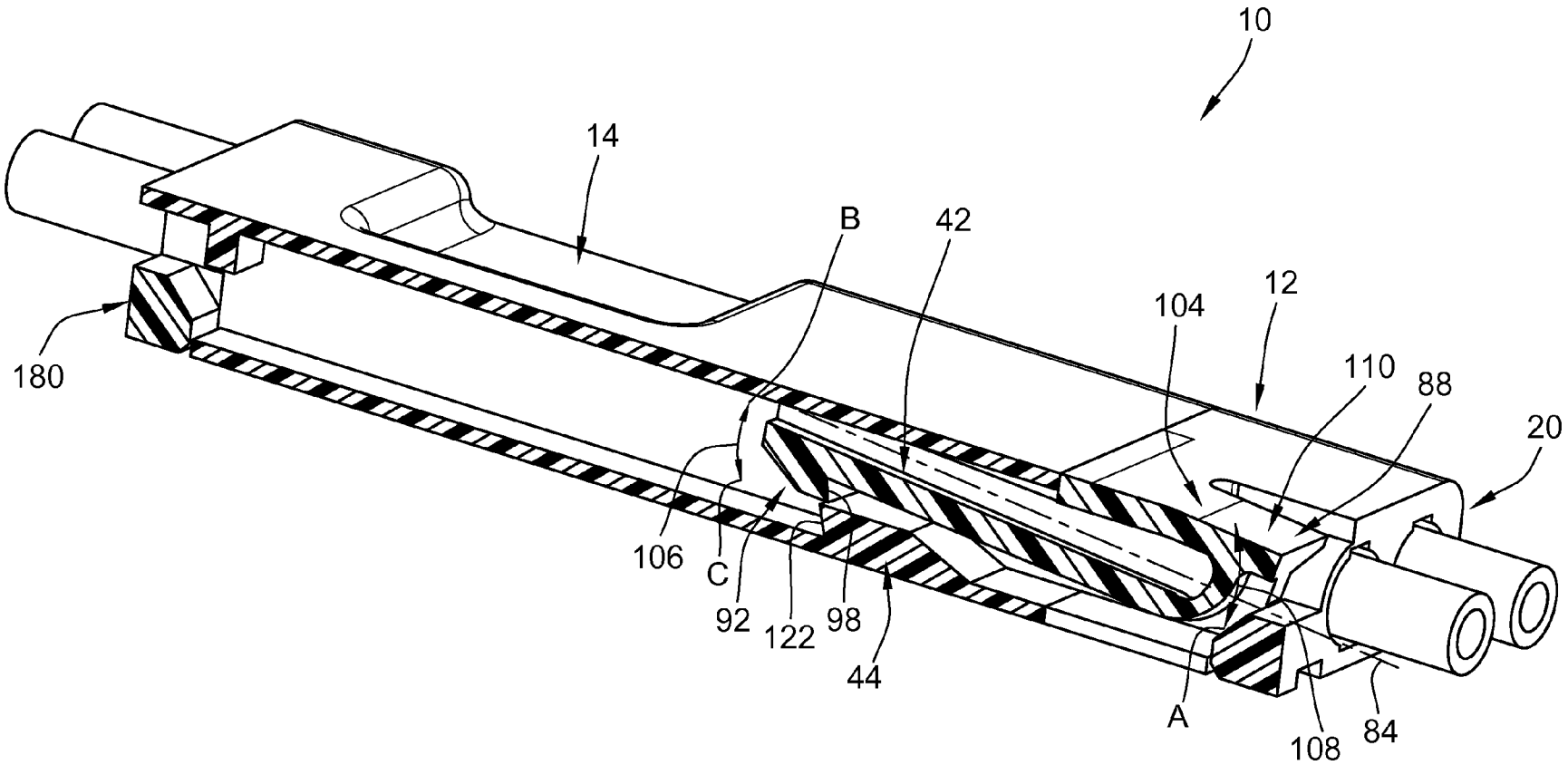
FIG. 7 is a perspective view of a cross section of the connector assembly shown in FIG. 1 illustrating a latch arm of the plug connector in an unlatched position.

FIG. 7 is a perspective view of a cross section of the connector assembly 10 illustrating the latch arm 42 of the plug connector 12 in the unlatched position. To unlatch the latch arm 42, the release tab 110 is pressed to move the actuation end 88 of the latch arm 42 along the arc 108 in the direction of the arrow A. Movement of the actuation end 88 along the arc 108 in the direction of the arrow A causes the latch arm 42 to pivot about the flexing block 104, against the bias of the flexing block 104, such that the latch member 92 of the latch arm 42 moves along the arc 106 in the direction of the arrow B. Once the latch member 92 has moved far enough along the arc 106 in the direction of the arrow B such that latching surface 98 of the latch arm 42 clears the latching surface 122 of the latch element 44, the connectors 12 and 14 can be separated by moving the connectors 12 and 14 in opposite directions along the connection axis 16 (FIG. 1).

The embodiments described and/or illustrated herein may provide a connector and/or a connector assembly that is less likely to catch or snag on obstructions when pulled through a structure. The embodiments described and/or illustrated herein may provide a connector and/or a connector assembly that is less likely to be damaged when pulled through a structure and/or is less likely to damage the structure and/or any obstructions when pulled through the structure. The embodiments described and/or illustrated herein may provide a connector and/or a connector assembly having latch components that are less likely to be damaged when pulled through a structure. The embodiments described and/or illustrated herein may provide a connector and/or connector assembly that is more easily installed. The embodiments described and/or illustrated herein may provide a connector and/or a connector assembly having a latch arm that is less likely to be being pried to an unlatched position and is therefore less likely to be damaged and/or inadvertently unlatched.

Although the embodiments described and/or illustrated herein are described and illustrated herein with reference to electrical wires and electrical connectors, the embodiments described and/or illustrated herein are not limited to electrical connectors and electrical wires. Rather, the embodiments described and/or illustrated herein may be used with any type of connector and any type of wire, such as, but not limited to, optical connectors and optical fiber.

The terms "plug" and "receptacle" as applied to the connectors 12 and 14 are intended only to refer to the pluggable nature of the latch arm 42 into the latch receptacle 114. Although the connector 12 is described and illustrated herein as having the plugs 62 that are received within the sockets 64 of the connector 14, in alternative embodiments the connector 14 may include one or more plugs (not shown) received within one or more sockets (not shown) of the connector 12. In such an alternative embodiment, the connector 12 is still considered to be a plug connector because the connector 12 includes the pluggable latch arm 42, and the connector 14 is still considered to be a receptacle connector because the connector 14 includes the latch receptacle 114. In other alternative embodiments, the connector 14 includes a pluggable latch arm (not shown) and the connector 12 includes a latch receptacle (not shown). In such an alternative embodiment, the connector 14 is considered a plug connector because of the pluggable latch arm, while the connector 12 is considered a receptacle connector because of the latch receptacle.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A connector assembly comprising:

a receptacle connector comprising a receptacle connector housing extending in a longitudinal direction that is transverse to a connection direction and having an interior cavity, the receptacle connector comprising a latch element extending transversely to the longitudinal direction and within the interior cavity of the receptacle housing, the receptacle housing holding a receptacle connector contact;

a plug connector comprising a plug connector housing engaged with the receptacle connector housing, the plug connector housing holding a plug connector contact, the plug connector contact being engaged with the receptacle connector contact, the plug connector comprising a latch arm extending outwardly from the plug connector housing, the latch arm comprising a latch member received within the interior cavity of the receptacle connector housing, the latch member being engaged with the latch element of the receptacle connector entirely within the interior cavity of the receptacle connector housing; and the receptacle connector housing comprises a pair of discrete sockets, at least one receptacle connector contact being held within each of the sockets, the interior cavity extending between the sockets.

2. The connector assembly according to claim 1, wherein the receptacle connector housing comprises an interior surface that defines a boundary of the interior cavity, the latch element of the receptacle connector comprising a shoulder extending outwardly from the interior surface into the interior cavity of the receptacle connector housing.

3. The connector assembly according to claim 1, wherein the receptacle connector housing comprises a mating end engaged with the plug connector housing, the interior cavity of the receptacle connector housing comprises a latch receptacle extending into the mating end of the receptacle connector housing.

4. A connector configured to latch and unlatch with a mating connector having a latch receptacle and a latch element extending within the latch receptacle, the connector comprising:

a housing extending in a longitudinal direction that is transverse to a connection direction and comprising a base and a plurality of extensions extending outwardly from the base within a plane, the extensions being configured to engage the mating connector;

a plurality of contacts, each contact being held by a corresponding one of the extensions;

a latch arm extending outwardly from the base of the housing, the latch arm extending within the plane between two adjacent extensions of the plurality of extensions, the latch arm being configured to be received within the latch receptacle of the mating connector, the latch arm comprising a latch member extending transversely to the longitudinal direction and configured to engage the latch element of the mating connector; and the extensions comprise plugs that are each configured to be received within a discrete socket of the mating connector.

5. The receptacle connector assembly according to claim 1, wherein the latch element of the connector comprises a ramp surface, the latch member of the mating connector riding along the ramp surface as the connector and the mating connector are mated together.

6. The connector assembly according to claim 1, wherein the receptacle connector housing comprises a socket, the receptacle connector contact being held within the socket, the socket being discrete and isolated from the interior cavity of the receptacle connector housing.

7. The connector assembly according to claim 1, wherein the latch member of the latch arm comprises a hook.

8. The connector assembly according to claim 1, wherein the latch arm of the plug connector extends a length from an actuation end to an engagement end, the engagement end comprising the latch member, the latch member being movable between a latched position wherein the latch member is engaged with the latch element of the receptacle connector and an unlatched position wherein the latch member is disengaged with the latch element of the receptacle connector.

9. The connector assembly according to claim 1, wherein the latch arm extends a length from an actuation end to an engagement end, the latch arm comprising a flexing extension extending from the actuation end, the flexing extension being connected to the plug connector housing, the latch arm being pivotable about the flexing extension.

10. The connector assembly according to claim 1, wherein the plug connector housing comprises a pair of outwardly extending plugs, each plug holding a corresponding plug connector contact, the latch arm extending outwardly from the plug connector housing between the plugs.

11. The connector assembly according to claim 1, wherein the latch arm of the mating connector extends a length from an actuation end to an engagement end, the engagement end comprising the latch member, the latch member being movable between a latched position and an unlatched position, the actuation end comprising a release tab for moving the latch arm from the latched position to the unlatched position, wherein the plug connector housing comprises a recess, at least a portion of the release tab being received within the recess.

12. A connector configured to latch and unlatch with a mating connector having a latch arm, the connector comprising:

a housing extending in a longitudinal direction that is transverse to a connection direction and comprising a mating end configured to engage the mating connector;

a contact held by the housing;

a latch receptacle extending into the mating end of the housing, the latch receptacle configured to receive the latch arm of the mating connector therein;

a latch element extending transversely to the longitudinal direction and entirely within the latch receptacle, the latch element comprising a latching surface configured to engage the latch arm of the mating connector; and the housing comprises sockets configured to receive a portion of the mating connector therein, the contact being held within the sockets, the sockets being discrete and isolated from the latch receptacle.

13. The connector according to claim 12, wherein the latch receptacle comprises an interior surface that defines a boundary of the latch receptacle, the latch element of the receptacle connector comprising a shoulder extending outwardly from the interior surface into the latch receptacle, the shoulder comprising the latching surface.

14. The connector according to claim 4, wherein the latch member of the latch arm comprises a hook.

15. The connector according to claim 12, wherein the latch receptacle comprises an interior surface that defines a boundary of the latch receptacle, the latch element extending from the interior surface, the latching surface of the latch element extending at an acute angle relative to the interior surface.

16. The connector according to claim 4, wherein the latch arm extends a length from an actuation end to an engagement end, the engagement end comprising the latch member, the latch member being movable between a latched position and an unlatched position, the actuation end comprising a release tab for moving the latch arm from the latched position to the unlatched position, wherein the housing comprises a recess, at least a portion of the release tab being received within the recess.

* * * * *